US006301196B1

(12) United States Patent
Daniel

(10) Patent No.: US 6,301,196 B1
(45) Date of Patent: Oct. 9, 2001

(54) MULTIPLE ALARM TIMEPIECE WITH PILL COMPARTMENTS

(76) Inventor: Stephen W. Daniel, 254 Wheatly Rd., Danville, VA (US) 24520

( * ) Notice: Subject to any disclaimer, the term of this patent is extended or adjusted under 35 U.S.C. 154(b) by 0 days.

(21) Appl. No.: 09/266,171

(22) Filed: Mar. 10, 1999

Related U.S. Application Data

(63) Continuation-in-part of application No. 08/914,461, filed on Aug. 19, 1997.

(51) Int. Cl.[7] ..... G04B 47/00
(52) U.S. Cl. ..... 368/10
(58) Field of Search ..... 360/10, 107–118, 360/278

(56) References Cited

U.S. PATENT DOCUMENTS

| | | | | |
|---|---|---|---|---|
| 4,483,626 | * | 11/1984 | Noble | 368/10 |
| 4,626,105 | * | 12/1986 | Miller | 368/10 |
| 4,748,600 | * | 5/1988 | Urquhart | 368/10 |
| 4,905,213 | * | 2/1990 | Masse et al. | 368/10 |
| 5,029,726 | * | 7/1991 | Pendill | 221/69 |

* cited by examiner

*Primary Examiner*—Bernard Roskoski
(74) *Attorney, Agent, or Firm*—Sheldon H. Parker

(57) ABSTRACT

A compact medication dispensing unit is disclosed consisting of a body forming a chamber with an open first end, a closed second end, a front, a back and at least two sides. A lid is hinged, preferably at the front of the body, to prevent access to the chamber. Dividers, either integral or removable, create multiple sub-chambers to separate medications. A securing member, such as a spring bias clip or a semi-rigid J-shaped clip, is affixed to the back of the body proximate the first end to maintain the vertical alignment of the ends. Programmable notification and display means enable a user to enter data and subsequently notify and display the entered data to the user. In another embodiment the interior chamber contains vertically oriented modules. The modules are rotatable within the interior chamber to open for accessibility and are preferably separated by rigidly affixed separators. The can rotate through use of a pivot member or a hinge. A stop member on each module prevents the modules from rotating beyond a predetermined amount. Closure members maintain the multiple modules within the interior chamber until released by a user. Springs, having sufficient force to push said module to an open position, can be affixed within the interior chamber proximate said module. Programmable notification and display means enable user entry of data and subsequently notifying and displaying the data to a user.

7 Claims, 5 Drawing Sheets

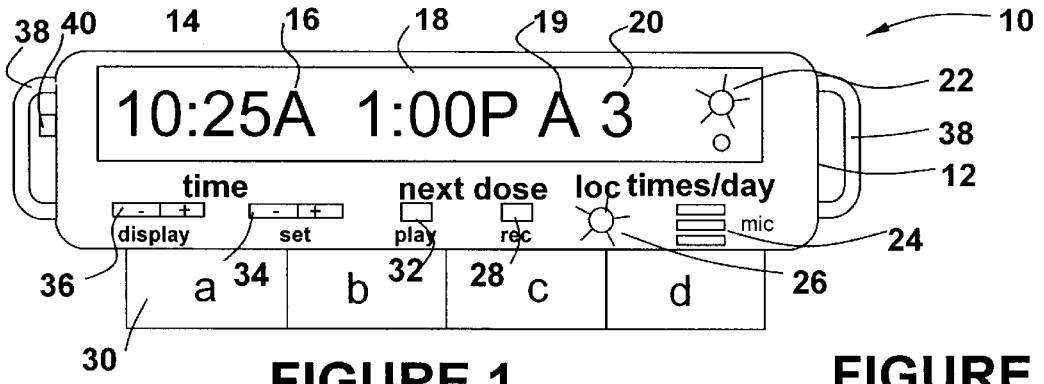
FIGURE 1
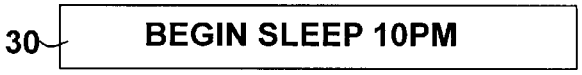
FIGURE 2
FIGURE 3
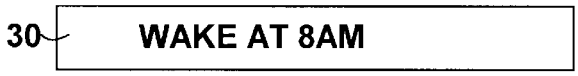
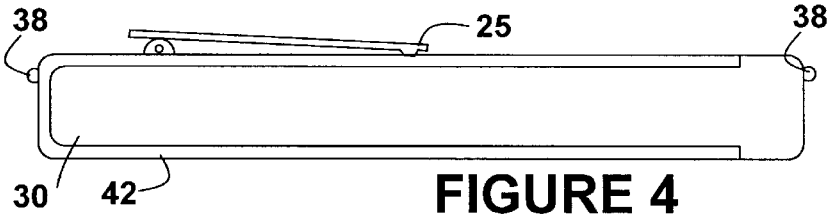
FIGURE 4
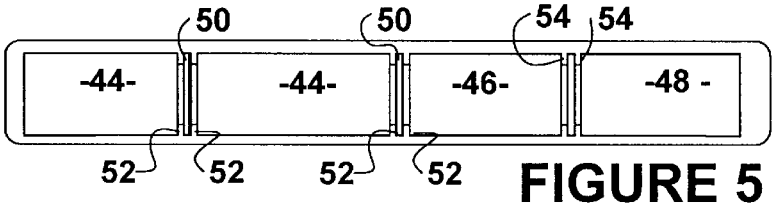
FIGURE 5
FIGURE 6
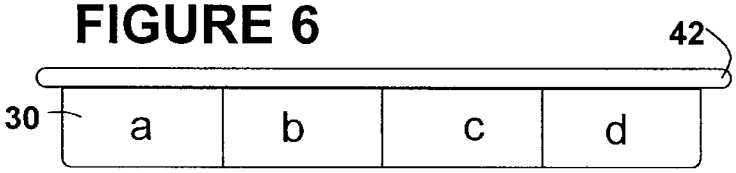
FIGURE 7
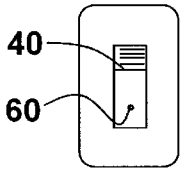
FIGURE 8
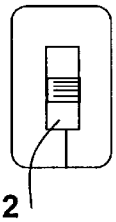
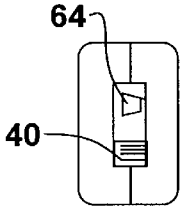
FIGURE 9

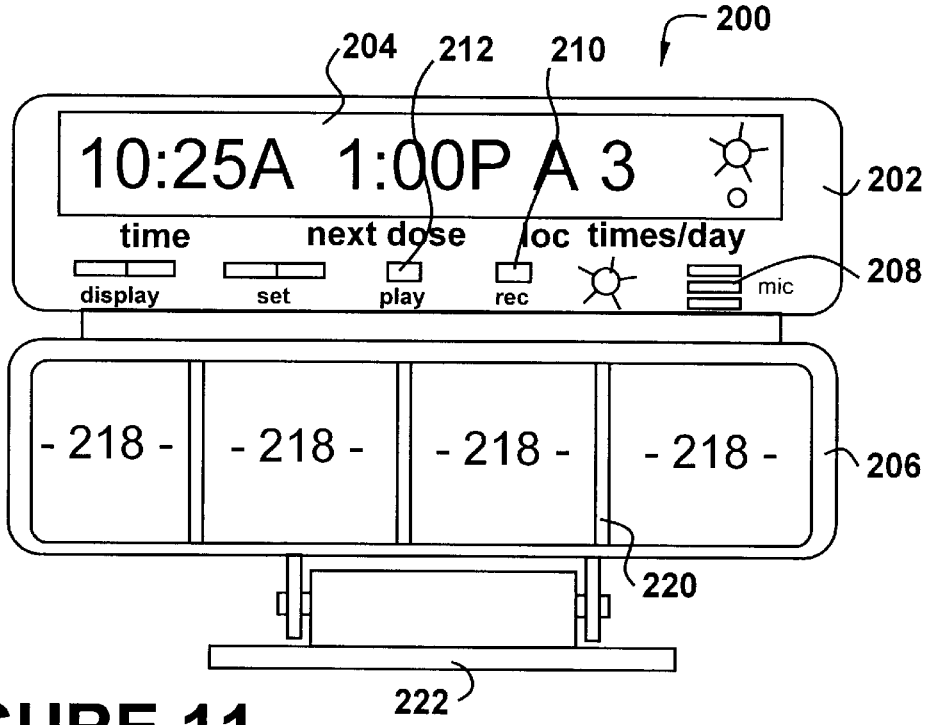
FIGURE 11
FIGURE 12
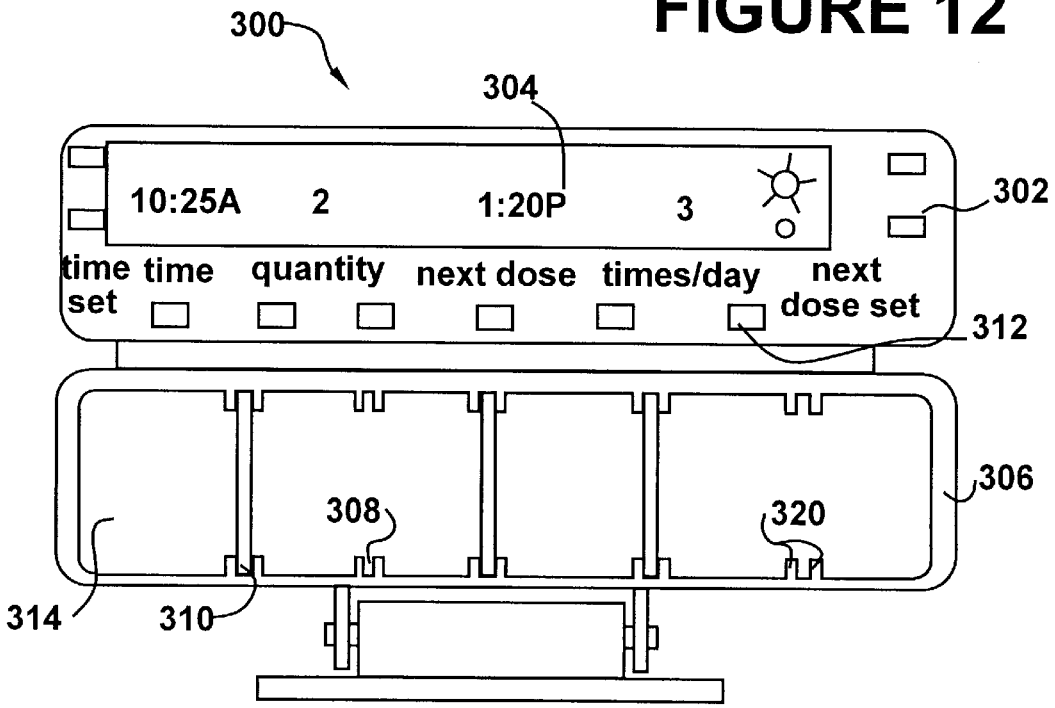

MULTIPLE ALARM TIMEPIECE WITH PILL COMPARTMENTS

CROSS-REFERENCE TO RELATED APPLICATION

This application is a continuation-in-part of copending U.S. patent application, Ser. No. 08/914,461, filed Aug. 19, 1997, the subject matter of which is incorporated herein by reference, as though recited in full.

BACKGROUND OF THE INVENTION

1. Field of the Invention

The present invention relates to the field of pillboxes with timepieces and alarms which remind the user to take medication at a certain time. More particularly, the device covers pill dispensers that use a liquid crystal display (LCD) mechanism and either vibrate and/or produce an audible alarm at the time that medication is scheduled to be taken. The invention also relates to electronic devices that can automatically calculate the next scheduled dosage based upon user input.

2. Brief Description of the Prior Art

Currently there is a great need for a device which can conveniently and confidentially remind a person when it is time to take a particular medicine. As the current population ages, more and more people ore taking high cholesterol medication, estrogen replacement therapy, high blood pressure medication, and a wide range of other medications, all at the same time. Different pills are on different schedules and must be taken at different intervals. This makes keeping track of all the different medications and time schedules very confusing.

Additionally, many people work in situations where an audible alarm simply is not acceptable. For example, lawyers, court clerks and judges must maintain a quiet atmosphere while court is in session. Teachers, bank tellers, shop clerks, hospital personnel and others in public service type jobs would also find it distracting to use audible alarm. Further, there are people who work or enjoy leisure pursuits in situations where they simply cannot hear an audible alarm. Some people work on construction sites, in factories or partake in noisy athletic events such as baseball, soccer, hockey, football and the like. And finally, other people are simply hard of hearing and can only respond to a vibrating alarm.

However, there are not many devices in the prior art which solve the problem of providing a silent or vibrating alarm, and more especially, one which conveniently provides a compartmental pill box corresponding to the number of alarms set which can be conveniently slipped onto a belt or into a pocket. For example, U.S. Pat. No. 5,367,505 issued to Tsuchiya, et.al., discloses a watch with a dumb alarm which is efficient in operation so as to consume less battery power by providing for a spiral spring for rotating an eccentric weight to create the vibrating alarm. However, this patent does not disclose the combination of providing a vibrating alarm with multiple settings and multiple corresponding pill compartments attached hereto.

Most timer devices relating to the dispensing of a medication are directed towards the purpose of accurately indicating when a pill from a particular container such as a pill bottle or blister package was last removed and then calculating the next proper time for a new dosage and sounding an alarm at that time. Accordingly, U.S. Pat. No. 4,364,955 issued to Ballew, U.S. Pat. No. 5,313,439 issued to Albeck and U.S. Pat. No. 5,233,571 are all related to pill bottle caps with audible alarms and visual alarms. U.S. Pat. No. 5,412,372 issued to Parkhurst, et al is but one example of a device which times the dispensing of blister pack packaged medication and stores and downloads pill dispensing times for later analysis by a health care professional.

Thus, in the prior art, there are many pill bottles with audible and/or visual alarms. The prior art also teaches a blister pack that monitors and transmits data concerning the taking of medication. There are, however, no pill containers with multiple compartments adjacent or removably secured to an electronic LCD display unit capable of storing several different alarm times, activating the alarm and then indicating which compartment contains the pill to be taken.

SUMMARY OF THE INVENTION

A medication dispensing unit is disclosed that has a preferred height on the order of about 3.5 inches, a width on the order of about 2 inches and a depth on the order of about ½ inch. The unit consists of a body that forms a chamber with an open first end, a closed second end, a front, a back and at least two sides. A lid is hinged to the first end of the body to prevent access to the chamber, preferably at the front of the body. Dividers within the chamber create multiple sub-chambers, each of the sub-chambers maintaining medication separate from the remaining sub-chambers. The dividers can be integral with said body or multiple pairs of opposing divider receiving slots can be molded within the chamber to receive dividers, enabling a user to create variable sized sub-chambers. A securing member has an open end and an affixed end and is affixed to the back of the body proximate the first end. The securing member can be a spring bias clip or a semi-rigid J-shaped clip and is positioned to maintain the first and second ends aligned vertically to one another. Programmable notification and display means enable a user to enter data and subsequently notify and display the entered data to the user. The programmable notification and display can be located within said lid. The user places medication within the chamber and clips said dispensing unit to clothing or user carried item.

In another embodiment the container for carrying and monitoring the medication of an individual patient has a hollow body with a first end; a second end, a front, a back and at least two sides to create an interior chamber. Multiple medication receiving modules, are vertically oriented within the body and are rotatable within the interior chamber to open for accessibility. Separators, rigidly affixed within the interior chamber, separate the modules from adjacent modules. Multiple rotation members proximate the second end of the chamber prevent complete removal of the modules. The rotation member can be a pivot member, affixed to the body and intersecting the module. Alternatively the rotation member can be a hinge. Stop members on each module prevent the modules from rotating beyond a predetermined amount. Multiple module closure members maintain the multiple modules within the interior chamber until released by a user. The multiple module closure members can be a pair of magnets, a first magnet being within the interior chamber proximate the first end and a second magnet affixed to a rotatable modules. The module closure members can also be rotatable latches proximate the first end of said body, with a first portion being affixed to the body and a second portion overlapping the modules. A securing member, affixed to the back of the body maintains the body in approximately a vertical position. Springs, having sufficient force to push said module to an open position, can be affixed within the interior chamber proximate said module. Programmable notification and display means enable user entry of data and subsequently notifying and displaying the data to a user. The notification and display means are preferably located at the first end of the body and covered by a lid, said lid being affixed to the body.

BRIEF DESCRIPTION OF THE DRAWINGS

The advantages of the instant disclosure will become more apparent when read with the specification and the drawings, wherein:

FIG. 1 is an elevated front view of the present invention showing the present invention displaying the current time; time for next scheduled dosage, number of dosages per day and the night on switch indicator FIG. 2 is an elevated front view of the LCD showing a sample display to choose the "begin sleep" mode.

FIG. 3 is on elevated front view of the LCD showing a sample display to choose the "wake" mode.

FIG. 4 is a bottom view of the timepiece portion of the instant invention showing the L-shaped flange to connect the pill compartment.

FIG. 5 is an elevated top view of the pill compartment showing removable dividers creating individual pill bins.

FIG. 6 is an elevated front view of the pill compartment showing labels for the various individual pill bins.

FIG. 7 is an elevated left side view of the present invention showing the timepiece in its off position.

FIG. 8 is an elevated left side view of the present invention showing the timepiece in its vibrating only position.

FIG. 9 is an elevated left side view of the present invention showing the timepiece in its audible alarm position.

FIG. 11 is a top view of another embodiment of the invention.

FIG. 12 is an alternate embodiment of the modification of FIG. 11.

DETAILED DESCRIPTION OF THE PREFERRED EMBODIMENTS

Figure 10:
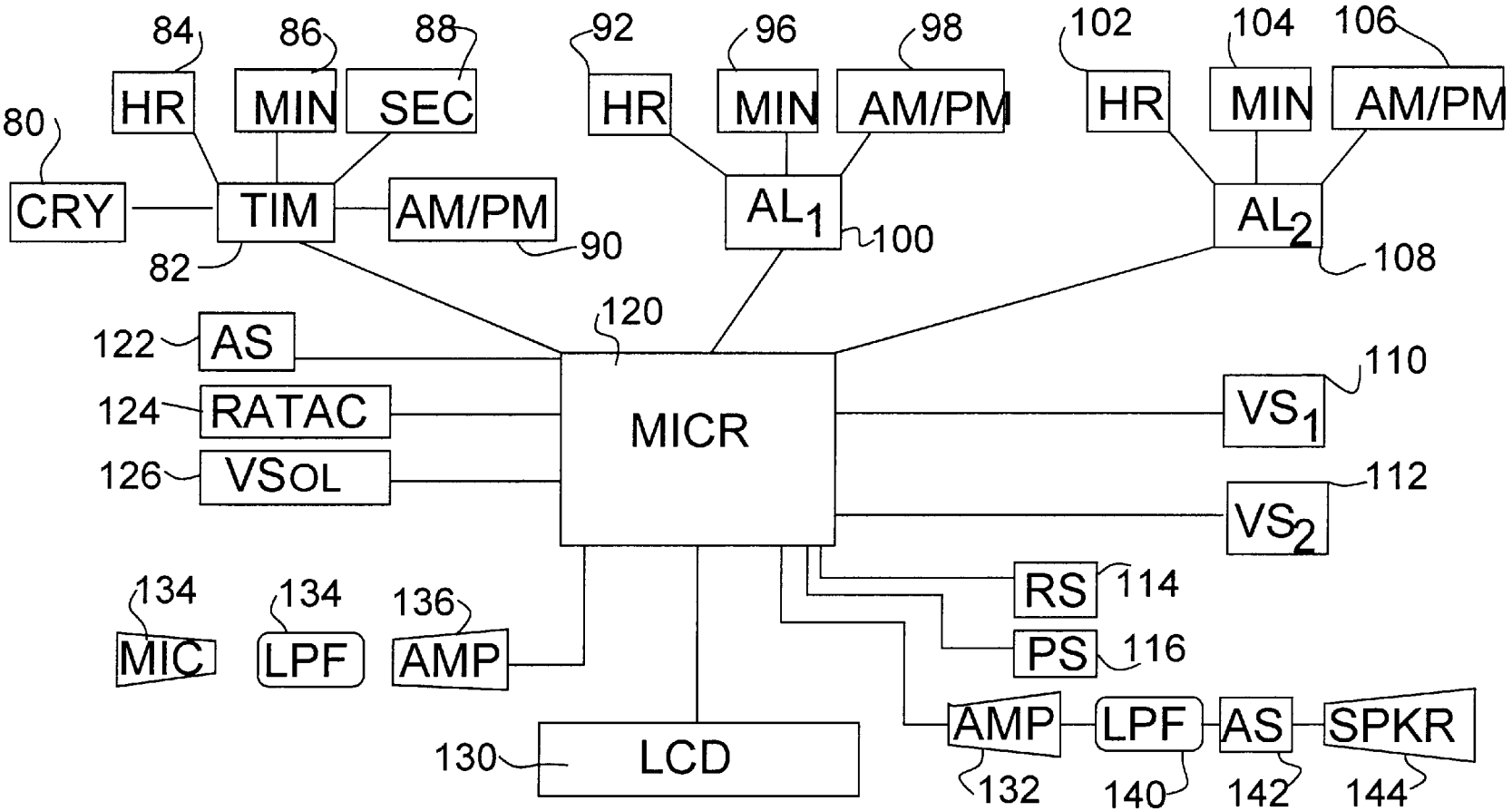
FIG. 10 shows a block diagram of the instant invention showing all options, including voice recordability for further instructions regarding medications being monitored.

Shown in FIG. 1 is an elevated front view of the present invention, electronic timepiece assembly 10. The assembly 10, as illustrated, consists of an electronic timepiece 12 containing a multiple segment LCD 15 containing current time segments 14. The LCD includes time segments 14, displaying the current time, as well as AM/PM display segments 16. Preferably the option to use military time is also incorporated within the electronics. The next dosage time display segments 18, display an settable alarm time to alert the user as to the time of the next scheduled dosage. The location display segments 19, which in one embodiment of the present invention, displays an "A", "B", "C", etc. which corresponds to a small attached bin 31, containing the medication to be dispensed, times/day display segments 20, which display the number of times per day the medication is scheduled to be taken and a day/night indicator 22 which can be set by the user to signal to electronic timepiece 12 whether to include or include night time hours when calculating time to next medication. Wristband ears 38 contain narrow rectangular apertures intended to securely retain an optional wristband (not shown) so that electronic timepiece can be secured to the user's wrist.

In order to set this particular embodiment, the user toggles one of the dual display push buttons 36, + or − to move forward or backward to set a particular feature of electronic timepiece 12. During normal setup, it is assumed that the user will be pushing the + button to move the clock forward. However, when a button is prematurely or inadvertently pushed too soon, it is helpful to know that the user can merely repeat the step by pushing dual display push button 36 "−" to go back to make any necessary corrections to a particular setting. Thus, to initialize electronic timepiece 12, the user will push + dual display push button 36 and the hour segment of current time 14 will begin to flash. The user can then push one of dual display set button 34 + or − to adjust the time, as needed. When the desired time is selected, the user can push the + button of dual display push button 36 to advance to the minute segments of current time display 141 which win begin to flash to indicate to the user that he or she can now press the − or + of the Set push button to properly set the minutes of current time display 14 and then the next segment will begin to flash, the AM/PM display segment 16 to indicate this display segment can now be set. The user can then push the dual set push buttons 34 to toggle AM or PM, as desired. When the proper setting has been set, the user can push the dual display push button 36 + to move on to set the next set of display segments on LCD 15, that is, next dose time segment 18, which consist of an hour, minute and AM/PM setting. These segments are set using the same procedure as setting the current time by moving forward with the + dual display push button and then advancing or subtracting minutes or hours with the dual set push buttons 34. The next segment to be set is location display segment 19, which when flashing, can be set with the dual set push buttons 34 by toggling the location display segment 19 through "A", "B", "C", "D" etc. When the correct setting for this segment is displayed, it can be selected by merely pushing the + of dual display push button 36, which will cause the day/night indicator 22 to flash This indicator, in one preferred embodiment is triggered "off" when bath a small sun with rays and a black moon is present indicating the device will alarm 24 hours per day. When only the small sun with rays is displayed, the day/night indicator is "on" and on alarm will only sound during the day, and sleep hours are ignored. When both the small sun and black moon are showing, the device will alarm day and night. When only the small sun is toggled on by the user during set up of electronic timepiece 2, it immediately enters into a screen to set sleep hours when the alarm will not sound and the calculation of alarm times will ignore the sleep hours set. In the present invention, electronic timepiece 12 contains sophisticated logical circuitry or software that the user first sets to initiate an alarm when the next dosage of medication is scheduled to be taken. The user will also set how many dosages per day must be taken. An alarm is then set. After the alarm has been triggered, the device will either generate a tone, a set of pulse tones or any other recorded audible tone as desired by the manufacturers or designers, or it will vibrate or vibrate in pulses, until alarm indicator switch 40 is depressed by the user to turn it off. During the time the alarm is sounded, the device will flash on the time scheduled for dosage and the location of the dosage for a period of time no more than say 7 to 10 minutes. If the user happens to miss the alarm and the dosage, the user can merely reset manually the next time to take a dosage so that too many dosages are not taken in one day. Sometimes, if the dosage is only an hour or two late and three or fewer dosages are taken during the day, then the alarm settings need not be changed. However, it four dosages are to be taken per day and the user takes a dosage two hours late, he or she will need to reset the device to take the next dose three hours later and leave the dosages per day at four per day The alarm will not sound during "sleep hours". The device then divides either 24 or the non-sleep hours by the number at dosages, truncates any fractional portion and adds this to the alarm previously set by either the user or the device.

In FIG. 2, LCD 30 shows the phrase "BEGIN SLEEP 10 PM". This is a suggested initial setting because it is close to normal hours when most people go to bed and would take their last dosage of medication. Using the dual button set button 34, the user can then toggle the value of the '10 PM" up or dawn to select a desired time he or she expects to go to sleep.

In FIG. 3, LCD 30 shows the phrase "WAKE AT 5 AM", which is the screen displayed immediately otter the user has set the "begin sleep" time and the dual display push button 36 has been pushed again. This message flashes to indicate that a time needs to be set. If the user desires to change the wake up time from 8 AM to another desired time, the user can merely toggle the dual set push buttons 34 up or down, as necessary. To select a final time, the user need only hit either the – or + dual display button 36 to move on in the setting process. Although in one embodiment of the invention ft is intended that once the sleep/wake times have been set by the user, they need not be set again for remaining alarms, this can easily be changed to suit the design specifications of the device.

Thus, during proper operation of electronic timepiece 12, the user sets alarm and a pill location A which can be retrieved from pill compartment 31 which has multiple bins. Most likely, the user will obtain medication from the pharmacist at a time during the day, place the desired pills in compartment A and set alarm I and a sleep period. Assuming a sleep period of B hours and that the user first obtained and took a pill at 1 PM and placed the remaining two pills for the day in bin A of pill compartment 31, the device will calculate 24–B=6, then divide by 4 times per day. The first alarm was set to 1 PM, it is triggered and electronic timepiece adds 4 hours to 1 PM, meaning electronic timepiece will next sound at 5 PM. After 5 PM is reached, the alarm is sounded, it is either reset by the user or resets itself, now for 9 PM. If this is not during a "sleep hour", it will resound again and reset itself until it reaches a sleep hour. When it reaches a "sleep hour" it will not sound, but instead will reset itself to the "wake hour". After the "wake hour" alarm has sounded, it will continue to reset itself according to a normal schedule. In this manner, electronic timepiece always is capable of setting a correct schedule for even dispensing of medication.

FIG. 4 shows a bottom view of electronic timepiece 12 showing how the pill compartment 31 is slidably attached to electronic timepiece via L-shaped lip or flange 42 which runs along three sides of the periphery of the bottom of electronic timepiece 12 in such a manner, pill compartment 31 can be inserted or removed from electronic timepiece 12 to fill it or remove pills from pill compartment 31. FIG. 4 also shows a spring-based clip 25 which enables the device to attach easily and securely to clothing.

FIG. 5 shows a top elevated view of pill compartment 31 into which the four possible bins can be divided with three slidably removable separators. In this particular view, only two removable bin separator 50 are shown in place which are securely retained between raised humps 42 which run down the interior walls and bottom of pill compartment 30. Since the removable bin separator 50 can be easily slid into and out of place, the user of electronic timepiece can create up to four compartments, if desired or only one large compartment for larger or more numerous pills, as desired. If only two medications are taken, only one removable bin separators 50 is needed, and the others can be removed and stored by the user for later use. in such a manner, the user can be provided with much greater flexibility In use of the device. of course, four bins is only one example of how pill compartment 31 can be arranged, and other bin compartment sizes and arrangements are contemplated and shall be considered as being included in the overall scope of this invention.

The outer case of electronic timepiece 12 can be constructed from a very heavy rigid plastic or other co-polymer so as to be very rigid and solid to protect interior contents of electronic timepiece 12, which consist of small electronic components that are relatively delicate from shock trauma and injury. Additionally, the device should be somewhat water resistant and hold the pills securely. The pill compartment 31 can be made from a less rigid plastic or other copolymer to provide necessary flexibility when inserting or removing the pill compartment 31 and to assure some water resistance.

FIG. 6 shows a front elevated view of pill compartment 31 in which the individual pill bins have been clearly labeled "a", "b", "c" and "d".

FIGS. 7, 8 and 9 are left side elevated views of electronic timepiece 12 where the pill compartment 31 has been removed. In this view it is clearly seen how alarm indicator switch 40 has three positions: off only, shown in FIG. 7 with a small off Indicator dot 60; vibrate only, shown in FIG. 8 with a wavy line indicator 62; and, audible tone only, shown in FIG. 9 with a small bell indicator 9. In such on arrangement, a user can easily switch between the several modes, depending on the situation encountered and whether the user needs to be reminded in the immediate future of medication (perhaps the wearer is taking a nap and does not want to be bothered for a few hours), or whether vibrator only is needed and the device will be clipped to a waist band of pants or skirt or slipped into a pocket, or whether the user desires a very loud, distinctive alarm.

FIG. 10 shows a block diagram of all the electronic components and circuitry necessary in one preferred embodiment of the device which would enable one skilled in the art to assemble a working electronic timepiece 12. In this Figure, a standard time crystal generator 80 is provided with a frequency of 32.768 kHz that can create a highly accurate second which is transferred to time control circuitry 82 which adds the second to the seconds register 88. When the seconds register reaches 60, it is zeroed out and a minute is added to minute register 86 In a similar manner when minute register 86 reaches 60, it is zeroed out and an hour is added to hour register 84. When hour register 84 reaches 12 it is zeroed out and AM/PM registered is toggled. A microprocessor 120 is used to control all of these functions. Of course, when current time is set by the user, the hour register 84 and minute register 86 are provided with values input directly by the user.

When an alarm is set for alarm 1 circuitry 100, the user directly inputs a value into alarm hour 1 register 92 and minute 1 register 96 as well as AM/PM 1 register 98. Microprocessor 120 then continually compares the current time stored in hour register 84, minute register 86 and am/pm register 90 with the alarm time to detect a coincidence situation. When this coincidence situation is detected, the microprocessor 120 enters an alarm subroutine and an alarm is triggered according to the information contained in alarm switch 122, which is set to either off, vibrate only or audible tone as shown in FIGS. 7, 8 or 9. The user will then be given a set time period to respond, either 5 minutes or more and then the alarm will automatically reset itself with a new alarm value as described in the procedure outlined above. While the alarm is actively sounding, the device will continually flash the pill location and the scheduled alarm time on LCD 15 until the alarm is reset by the user. The next scheduled medication and the location will be displayed with the current time until that alarm is sounded.

Likewise, since there are four pill bins shown in pill compartment 30 of the embodiment shown herein, a second alarm for a second medication also can be set which is controlled by alarm 2 circuitry 108. A pill can be placed in bin "B" and a second alarm time is set by inputting a value into hour 2 register 102 and minute register 104 and AM/PM 2 register 106. Once this second alarm is sat, microprocessor 120 will then continually compare the values of alarm 2 hour register 102 and minute 2 alarm register 104 with the current time register hour register 84 and minute register 84 for a coincidence. situation. When the coincidence situation occurs, an alarm is sounded, and electronic timepiece 12 will begin its alarm subroutine where alarm switch 122 is checked for the off position, vibrate only position or audible tone position and invoke one of these three alarm modes. When a vibrating alarm is used, this will trigger vibrating solenoid 126 to begin vibrating an off center weight. Such an electronic component is well known in the art and readily available in the marketplace. However, when a tone alarm is used, microprocessor 120 will trigger recordable analog tone generator 124 to emit an audible tone through speaker 144. Such recordable audible tone generators are readily available in the marketplace and well known to those skilled in the art. Recordable audible tone generators allow a wide variety of tones to be used according to the design requirements specified for the device by the manufacturer or designer.

In such a manner, additional alarm circuits and alarm hour, minute and AM/PM registers can be added to electronic timepiece 12 so that as many alarms can be set as there are individual pill compartments attached. However, since it is anticipated that the present invention can be used to time even nonattached liquid medicines or even other events, many more alarm circuits and registers could be added to make the present invention more useful and are intended as being within the overall scope of this invention.

As an additional feature of one preferred embodiment, voice recording components can be added, all of which can be controlled by microprocessor 120. In such a manner, the user can record various instructions regarding the medication to be taken such as "take with water", "take with food", "take two green pills", etc. In this instance, a microphone 132 is added to the device and is shown on FIG. 1 as microphone 24. The microphone collects an analog sound which signal is passed through low pass filter in 134 and into amplifier in 136. Microprocessor 120 then converts the audible analog sound into digital information at a predetermined "(Ps speed of from typically 8 kps to 12 kps. Of course, the greater the (Ps, the higher quality sound will be played back to the user, but the greater amount of voice storage for this digitized sound information must be provided. The microprocessor 120 then stores the digitized sound information in voice I storage register 110 if this audible sound is to be associated with alarm 1. If the voice information is to be associated with alarm 2, then this digitized information will be stored in voice 2 storage register 112. The voice information is collected and stored while electronic timepiece 12 display made has been activated by pressing the dual display push button 36 to set information, and the storage register selected, either voice 1 storage register 110 or voice 2 storage register 112, which is determined by the location chosen by the user. The device will not record by pushing record button 28, unless and until the pill location information has been entered into electronic timepiece 12. At anytime thereafter, the user can depress record button 28 an electronic timepiece 12 and a record indicator light 26 (preferably a red color) will glow for a predetermined period of time, typically from 10 to 15 seconds to record the message desired. If desired, the user can play back this message by depressing playback push button 32 to listen to the message so recorded if the user wants to change or re-record the message, the user can do so at anytime while the desired location is displayed by pushing the record button. The desired location will be displayed either after immediately being set by the user, or if there is an alarm time set and the location desired happens to correspond to the next alarm scheduled. If a different alarm is scheduled next, then the user will need to advance the + dual display push button 36 until it advances to show the location display segment 19 flashing. The user can set or re-record a message to correspond to that alarm time.

Similarly, after an alarm has sounded, the user can turn off that alarm by pushing the play push button 32 to play the message corresponding to that alarm. Alternatively, the user can depress the alarm indicator switch 40 and, at a later date, advance the location display segment 19 to conduct a playback of a message associated with the last alarm sounded.

Playback is achieved by the microprocessor 120 retrieving the associated digitized sound information associated with either voice 1 storage register 110 or voice 2 storage register 112. The digitized information is converted to an analog signal, processed through amplifier out 138, low pass filter out 140 and through analog switch 142 to separate an analog tone from an analog voice signal. The analog signal is then reconverted to an audible one through speaker 144.

In the preferred embodiments illustrated in FIGS. 11–19, the dispensing devices are small units, the size of a pager or less, that clip to clothing or fit in pockets or pocketbooks. In the preferred embodiment the disclosed dispensing units are approximately 2 inches by 3.5 inches and have a depth of about ½ inch, although these dimensions can vary dependent upon end use. In FIG. 11, the dispensing device 200 is illustrated with the lid 202 in the open position showing examples of indicators appropriate for use with dispensing medication. In this embodiment, the LCD display panel 204 indicates the current time, next dose, location of the pill container and how many times per day the pills are to be taken. The dispensing device 200 further enables the user to record verbal reminders, instructions, etc. which can be played back as required. The recording can be a message regarding all medications or can coordinate with the medication specific to the dosage time. The instructions are recorded into the system through use of the microphone 208 and record button 210. Once the alarm is activated the user can either play back the instructions through use of the play button 212 or the system can be set to play back automatically once the alarm stops. To record instructions specific to the dose time, the dose time is set and the recording completed for that dosage. This procedure is repeated until all dosage times are set and their instructions recorded. Alternatively, the data input method can be through infra red or bar scan. This enables the pharmacist to scan in medication schedules to ensure accurate pill dosages and administration times. The specific electronics can vary dependent upon manufacturer's preference and will be well known to those skilled in the art.

The pill container 206 is divided into separate sections to separate the pills into a category. Generally, this is done by dosage times, although types of pills can be grouped together, and the arrangement is based on individual user preference. The dividers 220 in this embodiment are permanently secured to container 206 and, although four (4) individual modules 218 are illustrated, a greater or lesser number can be provided.

Figure 14:
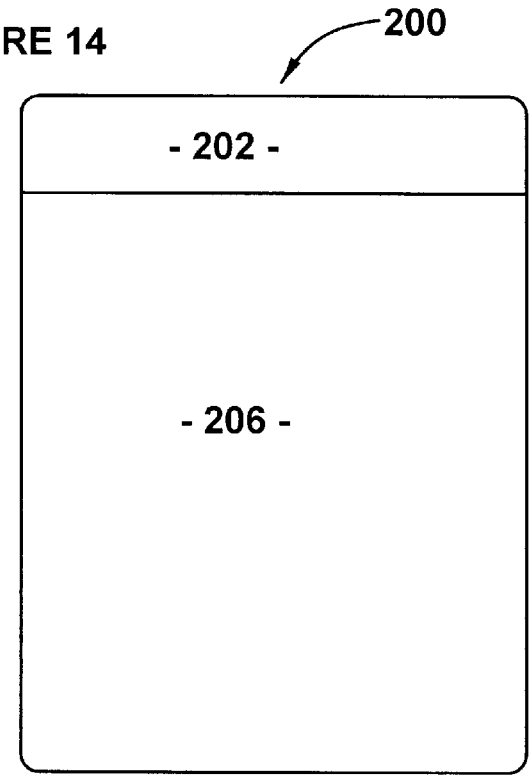
FIG. 14 is a front elevational view of the device of FIG. 11.
Figure 15:
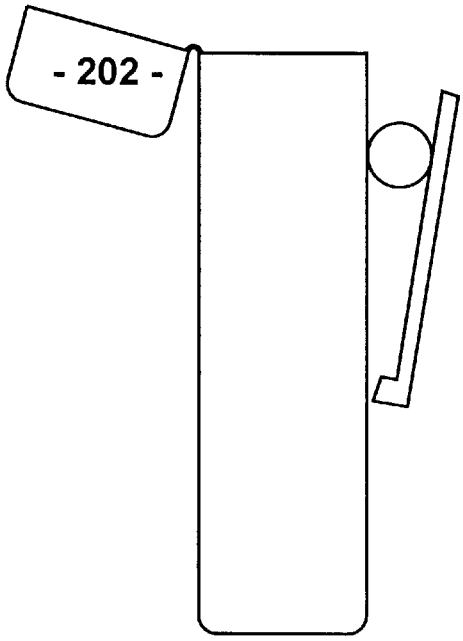
FIG. 15 is a side view of the embodiment of FIG. 13, showing the top element in the open position and showing a clip element.

In FIGS. 14 and 15, the dispenser 200 is illustrated in front and side views respectively. The lid 202 in FIG. 15 opens opposite the clip 222, however the hinge 224 can be placed on the same side as the clip 222. When the hinge is placed on the same side as the clip, the lid will require dimensioning to enable the open lid to fit between the dispenser and the top of the clip.

Figure 13:
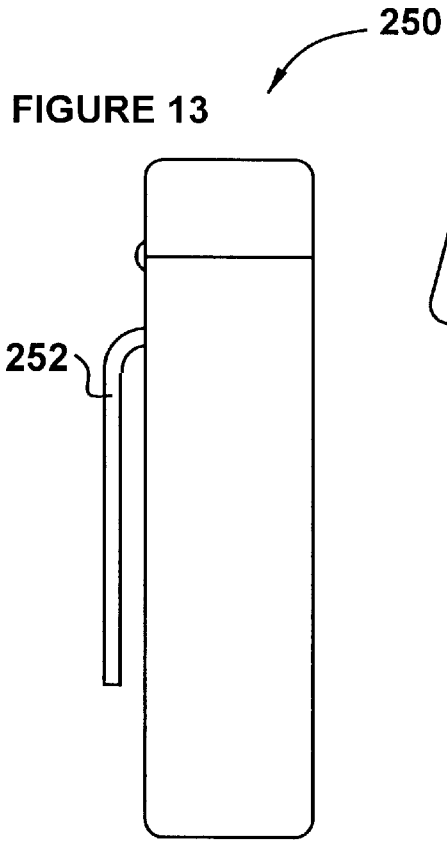
FIG. 13 is a side view of the embodiment of FIGS. 11 and 12, showing the device in a closed condition.

The clip 222 is affixed to the outer wall of the pill container 206 and, in this embodiment, is similar to pager clips. The clip 222 enables the pill dispensers disclosed herein to be secured to clothing, purses, etc. Alternatively, the pill container can be provided with a stationary hook clip 252 as shown in FIG. 13. The stationary hook clip 252 is a flexible member that slides over the user's belt, pocket, etc.

In FIG. 12 an alternative to the foregoing lid 202 and container 206 is illustrated. In this example the lid 302 of the dispenser 300 is provided with a display 304 that shows the time, number of pills to take, time of the next dose, and number of doses per day. LCD module lights 312 are placed within the lid 302 proximate each of the pill modules 314. The module lights 312 are programmed to illuminate in an order that indicates which of the modules 314 contains the pills for the current dose. The module lights 312 are preferably programmed by the user to enable customization of each individual's preferences and needs. This embodiment provides more variation for the user in the event several different types of pills are taken. Since the lights are preferably programmable by the individual, and provide the ability to activate more than one light, the pills can be grouped by type rather than by dose. Thus, if two of one three types of pills are to be taken at 1:20 p.m., the module lights 312 above those modules 314 would be lit.

The container 306 is provided with divider receiving areas 308 that enable the dividers 310 to be removed, thereby customizing the size of the modules 314. In the illustrated embodiment the receiving areas 308 are formed from flanges 320, however, channels can be molded into the sides of the container 306 or spaced tabs provided to maintain the dividers 310 in place. When the lid 302 is combined with the container 306, module lights 312 would be provided for each possible module 314.

Figure 17:
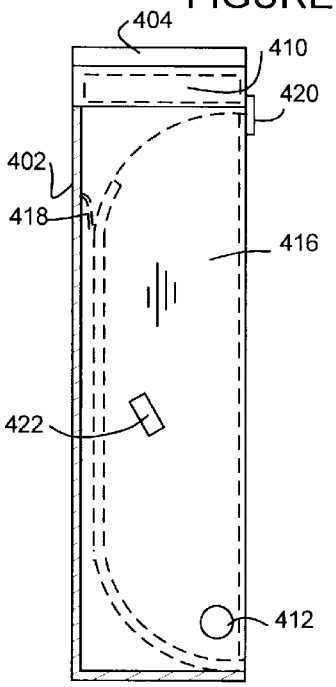
FIG. 17 is a side view of the embodiment of FIG. 16 with all compartments closed.
Figure 16:
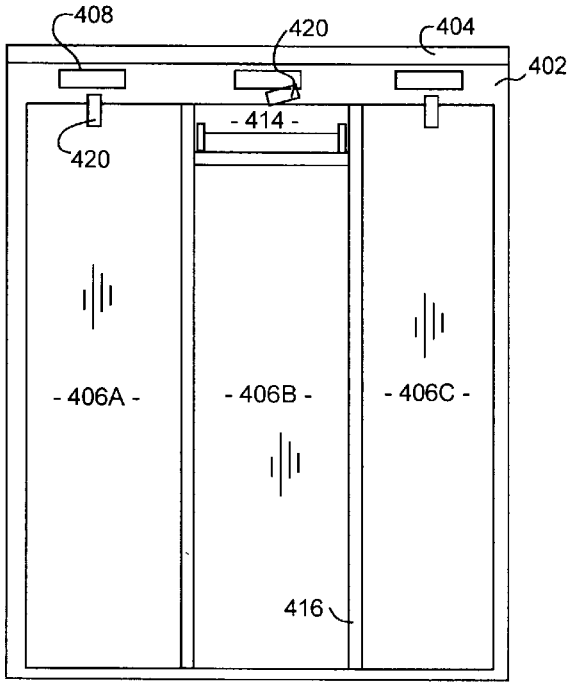
FIG 16 is a front view of a further embodiment of the invention, showing one compartment open.

An alternate embodiment is illustrated in FIGS. 16 and 17 wherein the pill modules 406 within the dispenser 400 are hinged on a pivot rod 412. The modules 406 pivot around the rod 412 to rotate open outwardly, as illustrated by module 406B of FIG. 17. Other methods of pivoting the chambers within the body can be used, such as leaf hinges, and will be obvious to those skilled in the art. The body 402 of the dispenser 400 is provided with multiple receiving chambers 414 to receive the modules 406. Although in this embodiment the receiving chambers 414 are separated by dividers 416 to prevent the modules 406 from binding or rubbing against one another, the body can be a single area without dividers 416.

The electronic area 410 of the dispenser 400 is located in the upper portion of the body 402 and contains the LED readouts and setting buttons, etc. As stated heretofore, the specific items displayed will depend upon manufacture preferences and the examples herein do not serve to limit the scope of the invention. As the lid 404 in this embodiment does not contain the readouts, but rather provides protection, the lid 404 can be manufactured from a clear material to enable the user to view the displayed information. The indicator lights 408 illustrated are placed along the front of the dispenser 400, although they can also be incorporated within the electronic area 410.

The modules 406 can be swung open using a number of methods known in the art. It is preferable that the surface of the dispensing device be smooth to avoid catching on objects and therefore knobs may be best avoided. A recessed slot can be provided in the front of the module to enable the user to pull out the module. Alternatively the hinge rod can be positioned to enable the bottom of the module to be pressed, pivoting the top of the module outward. In this embodiment, a spring 418 is provided within the receiving chamber 414 to force the module 406 into the open position once the selected securing device is released. To prevent the module 406 from rotating 180 degrees, a stop block 422 is provided. The stop block 422 interacts with the dividers 416 to maintain the module 406 at about a 45 degree angle. Other methods, compatible with the size and materials of manufacture, to maintain the module 406 at the desired degree of opening can be incorporated and will be known to those skilled in the art. To maintain the module 406 in the closed position shown in modules 406A and 406C, this embodiment uses as a securing device a slide lock 420. The slide lock 420 is secured to the body 402 by a pin that serves as a pivot point for the lock 420. The slide lock 420 rotates around the pin to release the module 406, enabling the spring 418 to push the module 406B into the open position.

Figure 19:
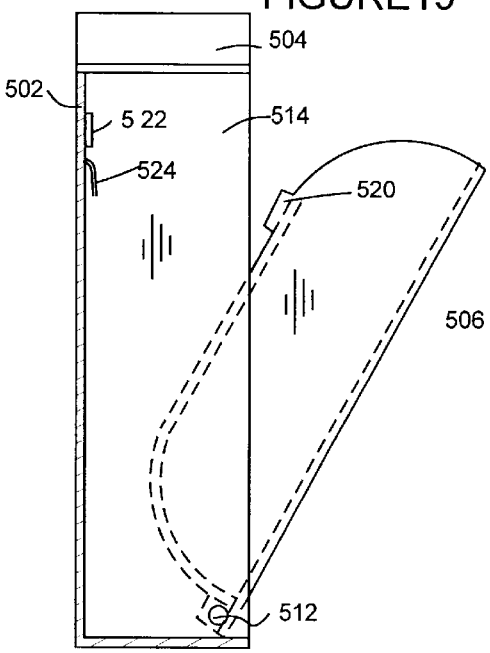
FIG. 19 is a side view the embodiment of FIG. 18.
Figure 18:
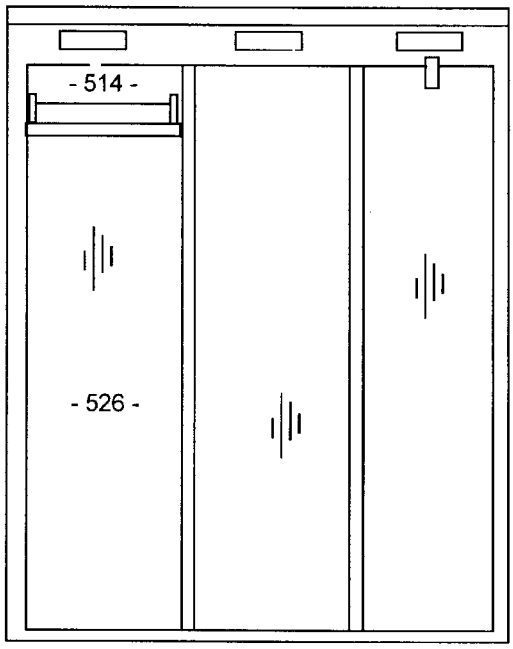
FIG. 18 is a front view of an additional embodiment of the invention showing one compartment open.

In an alternate locking method, the embodiment illustrated in FIGS. 18 and 19 incorporates a pair of magnets 520 and 522, positioned to mate, within the receiving chamber 514. The magnets 520 and 522 are the type commonly used for cabinet doors and alternate releasing and attaching. Preferably, a spring, such as leaf spring 524, is secured to the back of the receiving chamber 514. The leaf spring 524 must provide less pressure on the module 506 than the magnets 520 and 522 can counter to enable the module 506 to remain in the closed position. In this embodiment the electronics have been placed in the lid 504 as disclosed in the embodiments described in FIGS. 11–15.

It should be noted that the data displayed on the lids disclosed herein are for example only and are not intended to limit the scope of the invention. Additionally, any of the containers, lids, or clips disclosed herein can be combined with other lids, containers, or clips and the illustrations are provided for example only. Although in the foregoing detailed description the present invention has been described by reference to various specific embodiments, it is to be understood that modifications and alterations. In the structure and arrangement of those embodiments other than those specifically set forth herein can be achieved by those skilled in the art and that such modifications and alterations are to be considered as within the overall scope of this invention.

What is claimed is:

1. A medication dispensing unit, said medication dispensing unit having:

a body, said body forming a chamber having an open first end to enable dispensing of said medication, a closed second end, a front, a back and at least two sides;

dividers, said dividers being within said chamber and creating multiple sub-chambers within said chamber, wherein each of said sub-chambers maintains medication separate from remaining sub-chambers;

multiple pairs of receiving slots within said chamber for receiving said dividers to enable a user to create variable sized sub-chambers, wherein each of said pair opposes each other;

a lid, said lid being hinged to said body at said first end and preventing access to said chamber, a securing member, said securing member having an open end and an affixed end, said affixed end being affixed to said back proximate said first end and positioned to maintain said first end and said second end aligned vertically to one another;

programmable notification and display means, said notification and display means enabling user entry of data and subsequently notifying and displaying said data to said user;

wherein said user places medication within said chamber and clips said dispensing unit to said user's clothing or user carried item.

2. The unit of claim 1 wherein said programmable notification and display means are located within said lid.

3. The unit of claim 1 wherein said lid is hinged at said front of said body.

4. The unit of claim 1 wherein said dividers are integral with said body.

5. The unit of claim 1 wherein a distance between said first end and said second end is on the order of about 3.5 inches, between said at least two sides on the order of about 2 inches and between said front and said back on the order of about ½ inch.

6. The unit of claim 1 wherein said securing member is a spring bias clip.

7. The unit of claim 1 wherein said securing member is a semi-rigid J-shaped clip.

* * * * *